US006371387B1

(12) United States Patent
Nally et al.

(10) Patent No.: US 6,371,387 B1
(45) Date of Patent: Apr. 16, 2002

(54) AIR ASSIST METERING APPARATUS AND METHOD

(75) Inventors: Debora E. Nally, Williamsburg; John Boylan, Hampton, both of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 08/816,285

(22) Filed: Mar. 13, 1997

(51) Int. Cl.[7] ..... B05B 7/10; B05B 1/30; F02M 51/00

(52) U.S. Cl. ..... 239/408; 239/406; 239/585.1; 239/585.5

(58) Field of Search ..... 239/405, 406, 239/417.3, 585.5, 533.12, 408, 585.1

(56) References Cited

U.S. PATENT DOCUMENTS 1,413,134 A * 4/1922 Purnell ..... 239/405
1,980,132 A * 11/1934 Fletcher ..... 239/406
2,050,368 A * 8/1936 Neely ..... 239/406
3,383,049 A * 5/1968 Guerin ..... 239/406
5,108,037 A * 4/1992 Okamoto et al. ..... 239/533.12
5,174,505 A * 12/1992 Shen ..... 239/417.3
5,323,966 A * 6/1994 Buchholz et al. ..... 239/533 R
5,360,166 A 11/1994 Nogi et al. ..... 239/404
5,402,937 A * 4/1995 Buchholz et al. ..... 234/585.5
5,553,790 A 9/1996 Findler et al. ..... 239/585.1

FOREIGN PATENT DOCUMENTS

EP 0682179 A1 4/1995

* cited by examiner

*Primary Examiner*—Kevin Shaver
*Assistant Examiner*—Davis Hwu

(57) ABSTRACT

A method of air metering is provided for obtaining a desired air flow through a fuel injector. The fuel injector comprises an air assist injector valve body and an air assist backup washer, having two or more flow channels, contained within the backup washer. The fuel injector further comprises a shroud member having a flat surface, abutting up against the backup washer so the flat surface of the shroud member combined with the flow channels in the backup washer meter and/or direct the air flow.

9 Claims, 2 Drawing Sheets

AIR ASSIST METERING APPARATUS AND METHOD

FIELD OF THE INVENTION

This invention relates generally to fuel injectors of the type that are used to inject liquid fuel into the induction system of an internal combustion engine and having an atomizer that fits over the tip end of the injector to promote the atomization of the liquid fuel ejected by the fuel injector, and particularly to metering and directing the air required for an air assist fuel injector.

BACKGROUND OF THE INVENTION

Air assist atomization of the liquid fuel ejected from the tip end of a fuel injector is a known technique that is used to promote better preparation of the combustible air/fuel mixture that is introduced into the combustion chambers of an internal combustion engine. A better mixture preparation promotes both a cleaner and a more efficient combustion process, a desirable goal from the standpoint of both exhaust emissions and fuel economy.

Future engine emission requirements have driven the need to achieve better atomization of the fuel, breaking up the liquid fuel into small droplet size that would result in more thorough or efficient combustion. The improved atomization has been accomplished by a technique generally referred to as 'air assist', whereby when additional air at sonic velocity is aimed at the fuel, the impact of the air results in the air energy breaking up the liquid fuel droplets into droplets of a fine mist. This is then still aimed at the intake valve.

The state of the art contains a substantial number of patents relating to air assist atomization technology. The technology recognizes the benefits that can be gained by the inclusion of special assist air passages that direct the assist air into interaction with the ejected liquid fuel. Certain air assist fuel injection systems use pressurized air, from either a pump or some other source of pressurization, as the assist air. Other systems rely on the pressure differential that exists between the atmosphere and the engine's induction system during certain conditions of engine operation. It is a common technique to mount the fuel injectors in an engine manifold or fuel rail or engine head which is constructed to include assist air passages for delivering the assist air to the individual injectors.

Although several different methods of metering the air stream have been successful, one of the challenges in mass production of air assist fuel injectors remains in being able to take a production injector, and with a minimum number of design and processing changes, make it easily adaptable to an air assist application. Typically the design consists of three main parameters, which include the actual metering of the air to accomplish a known flow, a component for directing the flow, and the packaging required to contain the necessary seals to the engine.

One of the past concepts utilized a cup shaped metal air shroud, containing a through hole of limited size on the bottom of the cup. The cup was attached to the injector by welds through the side of the cup, to the outer diameter of the valve body. The air flow was metered, or restricted, by the circumference of the through hole, multiplied by the height that the through hole was away from the end of the injector. The injector shroud assembly would be flowed with air, and the height of the cup from the end of the valve body would be altered, in a calibrated manner, until the air flow desired was achieved. This concept was advantageous in that the same assembly could be utilized for a range of desired air flows, to match the range of customer demands for different air calibrations. However, the disadvantages include the requirement to have a calibrations step in the assembly/manufacturing process, which results in additional process time and cost. Furthermore, the direction of the metered air flow is perpendicular to the direction of the fluid flow, which has not been shown to be advantageous for fluid targeting geometry.

An alternative concept consisted of a metal shroud containing a metal air metering disc. The bottom portion of the cup sandwiched the disc to the end of the fuel injector, typically containing a special air metering disk at the end of the injector. The metering area was formed by the metering disc, with at least one channel allowing air passage from the outer diameter of the shroud, to the inner, exit hole of the shroud. The air shroud/metering disc assembly was attached to the valve body typically by a staking operation, deforming the shroud into the valve body. This concept had advantages in that the assembly process did not require a calibration operation, since the flow variation was kept to a minimum by the accuracy of the manufacturing process for the metering disc. Additionally, the air metering disk design was such that split stream air assist was feasible. However, the air flow in this concept is once again perpendicular to the fluid flow.

It is seen then that there exists a need for a method of air metering which allows any standard injector with a backup washer to be converted to an air assist injector, capable of air flow direction at different angles, which have targeting benefits.

SUMMARY OF THE INVENTION

This need is met by the air assist metering apparatus and method, according to the present invention. A typical injector valve body contains a retainer member; for air assist, an additional air metering device is provided. The surface of the retainer member protrudes beyond the crimp area of the valve body, and contains a flat surface which serves to seal the air metering disc. The present invention utilizes a air assist backup washer as the air metering or air directing component.

In accordance with one embodiment of the present invention, a method of air metering is provided for obtaining a desired air flow through a fuel injector. The fuel injector comprises an air assist injector valve body and an air assist backup washer, having two or more flow channels, contained within the backup washer. The fuel injector further comprises a shroud member having a flat surface, wherein the flat surface abuts up against the backup washer so the flat surface of the shroud member combined with the flow channels in the backup washer meter and/or direct the air flow.

It is an advantage of the present invention that it eliminates the need for an additional disk or insert to cooperate to provide the desired air flow. Consequently, the present invention provides the advantage of a higher quality air assist injector which is easier to manufacture.

For a full understanding of the nature and objects of the present invention, reference may be had to the following detailed description taken in conjunction with the accompanying drawings and the appended claims.

DESCRIPTION OF THE PREFERRED EMBODIMENT

Figure 1:
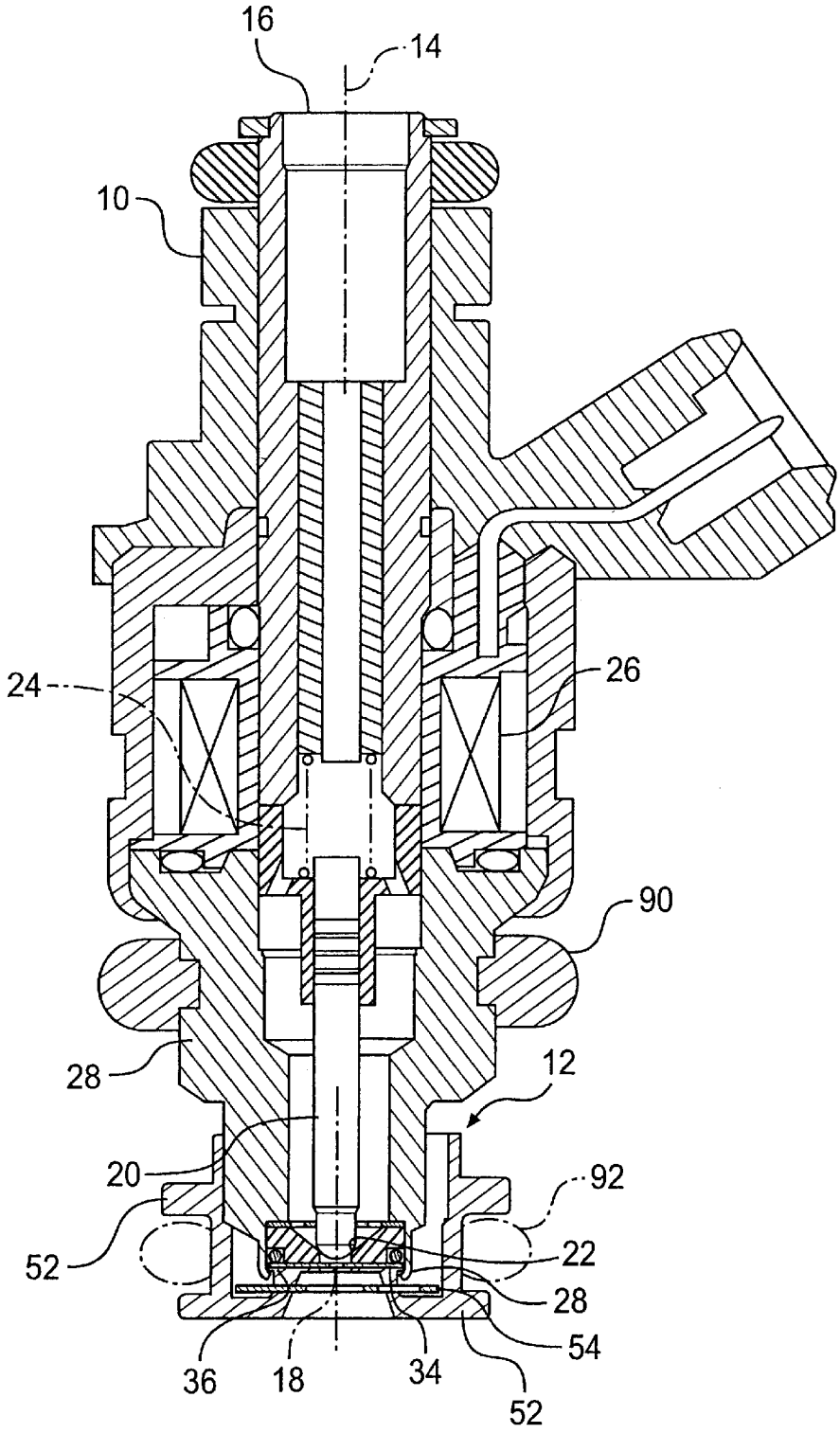
FIG. 1 PRIOR ART
FIG. 1 is a prior art longitudinal view through a fuel injector containing an air assist atomizer.
Figure 2:
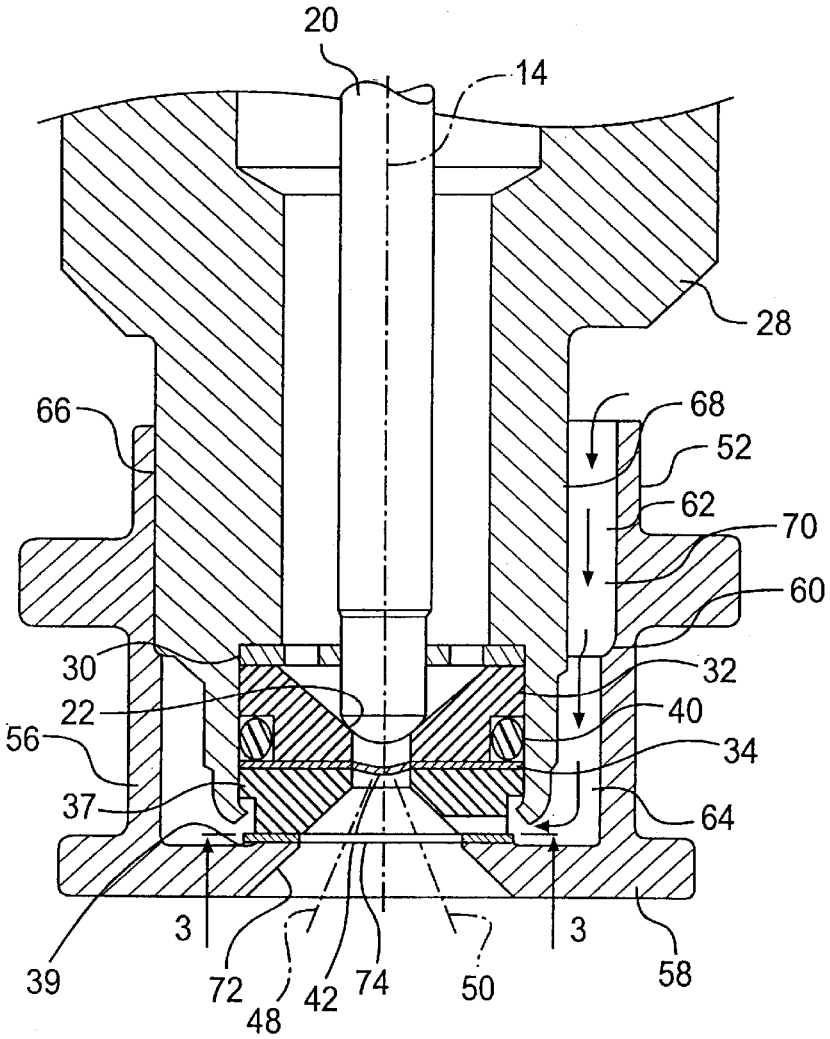
FIG. 2 is an enlarged view of a fuel injector outlet end, similar to that of FIG. 1, illustrating the air assist metering concept of the present invention.

Referring now to FIG. 1, there is shown, for purposes of description only, an electrically operated fuel injector 10 containing an air assist atomizer 12. The fuel injector 10 has a main longitudinal axis 14 and is a top-feed type device comprising an inlet 16 and a nozzle 18 at its opposite axial ends. The passage of liquid fuel through the fuel injector between the inlet 16 and the nozzle 18 is controlled by the seating and unseating of the rounded tip end of a metal needle 20 on and from a valve seat 22 located just interior of the nozzle 18. The needle 20 is resiliently biased by a spring 24 to seat on the seat 22 thereby closing the passage to flow. When the valve is electrically energized by the delivery of electric energizing current to its solenoid coil 26, the needle unseats to allow fuel flow. FIGS. 1 and 2 show the fuel injector closed.

When the engine is operating, the pressure in the induction passage associated with the fuel injector is sub-atmospheric. Hence, a pressure difference exists across the atomizer, and this differential is effective to cause air to pass axially through the atomizer and exit at the tip end of the atomizer, associated with the injector nozzle 18 which sprays out a fuel spray. The air that passes through the atomizer acts on the fuel spray as it is being emitted from the injector nozzle 18 to assist in the atomization of the liquid fuel entering the induction passage.

The construction in the vicinity of the outlet end, or nozzle 18, of the fuel injector of FIG. 1 is shown in greater detail in FIG. 2, but incorporating the construction of the present invention. The fuel injector comprises a generally tubular metal valve body 28 which contains in order of assembly at the outlet end, a metal needle guide member 30, a metal valve seat member 32, a thin disk orifice member 34 made of metal, and an air assist backup washer 37. The upper surface 39 of the backup washer 37 protrudes beyond the crimp area of the valve body 28 towards a shroud member 52.

In FIG. 1, the prior art air assist atomizer comprises two parts in assembly relation with the fuel injector, one part being a shroud 52 and the other being an air metering disc or insert 54. Referring to FIG. 2, the shroud member 52, which is substantially identical to that in FIG. 1, possesses a general cup shape having a side wall 56 and an end wall 58. The side wall 56 has a circular cylindrical inside diameter including a shoulder 60 that divides it into a larger diameter portion 62 and a smaller diameter portion 64. The portion 64 extends from immediate contiguousness with the end wall 58 to the shoulder 60 while the portion 62 extends from the shoulder 60 to the end of the shroud 52 that is opposite the end wall 58.

A portion of the valve body 28 has a nominally circular outside diameter 66 that is dimensioned to allow the portion 62 of the shroud 52 to snuggly fit onto it. However, that nominally circular outside diameter 66 is provided with one or more interruptions, such as an axial flat or slot 68, so as to thereby cooperatively define with the shroud's side wall 56 the entrance portion of an axially extending passage means 70 for assist air to flow axially along the outside of the valve body 28 toward the nozzle 18. The small arrows in FIG. 2 represent assist air flow.

The end wall 58 extends radially inwardly from the side wall 56 to provide an axially frusto-conically expanding aperture 72 which is coaxial with the axis 14 and through which fuel that has just been injected from the nozzle 18 passes. A raised circular annular ledge 74 extends from the flat inside surface of the end wall 58 in circumscription of the aperture 72. In contrast, as shown in FIG. 1, the air metering disk or insert 54 is disposed axially between the nozzle 18 and the end wall 58 and is in fact held between the shroud member 52 and the exterior axial end face of the retainer member 36.

The construction of the prior art injector which has thus far been described with respect to FIG. 1 is generally like that disclosed in certain commonly assigned issued patents, and therefore will not be described further at this time so that attention can be focused on the inventive features residing in the shroud member 52 and its association with the fuel injector 10. The insert 54, and the complications associated therewith, are described in great detail in commonly assigned U.S. Pat. No. 5,174,505, for an Air Assist Atomizer for Fuel Injector, issued to J. J. Shen on Dec. 29, 1992, and totally incorporated herein by reference.

Figure 3:
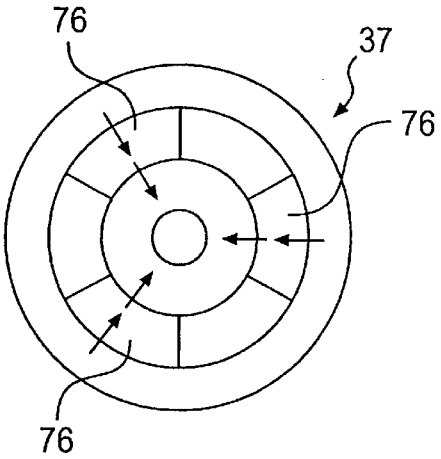
FIG. 3 is a view of a backup washer of FIG. 2 taken along line 3—3.
Figure 4:
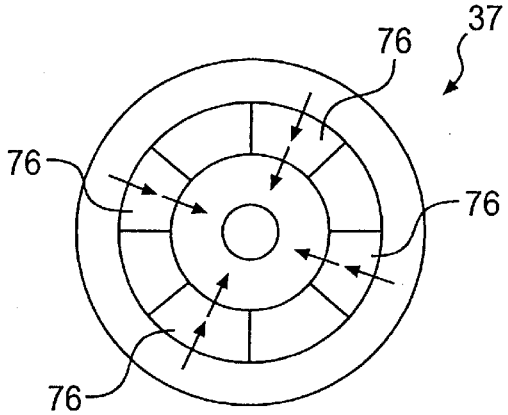
FIG. 4 is an alternate embodiment of the backup washer of FIG. 3.

The present invention utilizes the air assist backup washer 37 as the air metering component, eliminating the air metering disk or insert 54. The downstream end of the backup washer 37 comprises an angled surface, shaped for flow, and the inside end wall of the shroud member 52 corresponds to this shape directing the flow. The shroud member 52 and the backup washer 37 comprise matching geometries so the shroud surface member 52 abuts up against the backup washer 37 to direct the flow. Furthermore, the flat surface of the shroud member 52 combined with flow channels in the backup washer 37 meter the air flow. Air flow is indicated by arrows in FIGS. 3 and 4. At least two flow channels 76 are required, three are shown in FIG. 3, although more flow channels 76, as four are shown in FIG. 4, are perfectly acceptable as well.

The flow channels 76 are provided in the air assist backup washer 37 by any suitable means. For example, since a typical backup washer 37 is stamped, the air channels could be stamped into the washer 37 at the time of manufacture, allowing different washers for different flows. Alternatively, the flow channels 76 could be stamped into the washer 37 after it is assembled into the injector. A third option would be to form the channels with a metal working option, such as a laser. Yet another embodiment could utilize a powdered metal backup washer 37, and the channels 76 could be formed in the mold. Furthermore, in accordance with the present invention, the channels 76 could either be perpendicular to the fluid flow, and/or at an angle, to improve fluid targeting or to use for air direction. All of these options would eliminate the need for the additional an air metering disc or insert 54 of FIG. 1, and could further eliminate some of the orientation operation required on assembly. The air shroud member 52, whether metal or plastic, abuts its concave, or angled, bottom end up against the upper surface 39 of the backup washer 37. The flat surface of the shroud member 52 combined with the air channels 76 in the backup washer 37 meter and/or direct the flow.

In addition to the previously stated advantages, the present invention results in an air assist metering concept with lower manufacturing costs and increased design flexibility.

Having described the invention in detail and by reference to the preferred embodiment thereof, it will be apparent that other modifications and variations are possible without departing from the scope of the invention defined in the appended claims.

What is claimed is:

1. An air-assisted fuel injector having a nozzle from which fuel is injected into an induction air system of an internal combustion engine and an air assist module fitted onto the nozzle for directing assist air to flow axially along the outside of the nozzle and then radially inwardly toward injected fuel that has just left the nozzle to assist in atomizing the fuel, the fuel injector having a housing, the air assist module comprising:

a shroud member disposed over the nozzle, the shroud member having a side wall cooperating with the nozzle to form an axially extending air passage extending therethrough, the shroud member having an end wall extending radially inwardly from the side wall to form an aperture through which the injected fuel that has just left the nozzle passes; and a backup washer having a longitudinal axis and a downstream end in contact with the shroud member, the housing retaining the backup washer, the backup washer having a radially extending air passage communicating with the axially extending passage and the nozzle, the radially extending air passage maintaining a direction of the assist air from the axially extending air passage to the nozzle in a direction generally perpendicular to the longitudinal axis.

2. The air-assisted fuel injector according to claim 1, wherein the shroud further comprises an axially frustoconically expanding aperture along the longitudinal axis communicating with the nozzle.

3. The air-assisted fuel injector according to claim 1, wherein the radially extending air passage is generally perpendicular to the longitudinal axis.

4. The air-assisted fuel injector according to claim 1, wherein a fuel metering orifice is located upstream of the backup washer.

5. A method of adding assist air to fuel comprising:

providing a fuel injector having a fuel discharge end disposed along a longitudinal axis and a backup washer proximate the discharge end, the backup washer retaining at least a valve seat with respect to the fuel injector;

connecting a shroud to the fuel injector, the shroud contiguously engaging the backup washer to define an air passage communicating with a fuel outlet at the fuel discharge end; and providing pressurized air into the air passage, the air exiting the air passage at the fuel outlet in a direction generally perpendicular to the longitudinal axis, such that the pressurized air mixes with fuel in the fuel discharge end.

6. The method according to claim 5, wherein the pressurized air flows approximately perpendicular to a flow of the fuel in the fuel discharge end.

7. The method according to claim 5, wherein the air passage includes a first portion directing the pressurized air in a generally axial direction.

8. The method according to claim 7, wherein the air passage includes a second portion communicating, with the first portion, the second portion directing the pressurized air in a generally radial direction.

9. The method according to claim 5, wherein, when the pressurized air mixes with the fuel, the pressurized air assists in atomizing the fuel.

* * * * *